US005934898A

United States Patent [19]

Fayerman

[11] Patent Number: 5,934,898

[45] Date of Patent: Aug. 10, 1999

[54] BURNER NOZZLE WITH IMPROVED FLAME STABILITY

[75] Inventor: Matvey Fayerman, Rockford, Ill.

[73] Assignee: Eclipse Combustion, Inc., Rockford, Ill.

[21] Appl. No.: 08/935,669

[22] Filed: Sep. 23, 1997

[51] Int. Cl.[6] ..... F23D 14/46

[52] U.S. Cl. ..... 431/353; 431/181; 431/187

[58] Field of Search ..... 431/353, 354, 431/181, 187, 8, 9, 10; 239/402.5, 403, 404, 405, 406

[56] References Cited

U.S. PATENT DOCUMENTS

| | | | |
|---|---|---|---|
| 3,993,449 | 11/1976 | Childs | 431/353 |
| 4,297,093 | 10/1981 | Morimoto et al. | 431/8 |
| 5,195,884 | 3/1993 | Schwartz et al. | 431/8 |
| 5,263,849 | 11/1993 | Irwin et al. | 431/6 |
| 5,344,307 | 9/1994 | Schwartz et al. | 431/9 |
| 5,399,085 | 3/1995 | Taylor | 431/353 |
| 5,486,108 | 1/1996 | Kubota | 431/181 |
| 5,494,437 | 2/1996 | Kubota et al. | 431/181 |
| 5,520,537 | 5/1996 | Taylor | 431/353 |
| 5,542,839 | 8/1996 | Kelly | 431/10 |
| 5,554,022 | 9/1996 | Nabors, Jr. et al. | 431/10 |

OTHER PUBLICATIONS

Rhine, J.M. and Tucker, R.J., "Modeling of Gas–Fired Furnaces and Boilers" published in 1991, pp. 32–34.

Arutynov, V.A., Mitklinniy, U.I., and Stark, S.B., "Metallurgical Heat Technology, vol. 1, Fundamentals, Fuel and Refractory", published in 1974, pp. 242–244. A brief translation of the figures appearing on those pages is attached thereto.

*Primary Examiner*—James C. Yeung

*Attorney, Agent, or Firm*—Leydig, Voit & Mayer, Ltd.

[57] ABSTRACT

A burner nozzle having stable ignition and flame over a wide range of firing rates. The nozzle has a mixing plate which has air holes arranged in separate primary and secondary zones. The holes of the primary zone are located within approximately five times the diameter of fuel outlet ports so that the fuel exiting such ports has sufficient velocity to optimize mixing. The holes in the secondary zone are located farther away from the ports so that complete mixing takes place downstream of the nozzle. As a result, the present invention provides a burner nozzle with improved flame stability during ignition and operation and improved control over the amount of immediate and downstream combustion. The division of the mixing plate into primary and secondary zones further provides increased control over the amount of immediate and downstream combustion taking place. For example, by locating a certain percentage of air hole area in the primary zone, a corresponding percentage of combustion will take place in that zone. The exact percentages of holes in the primary and secondary zones may be selected according to the application. The mixing plate of the nozzle also has a frusto-conical shape which re-circulates hot gases towards the base of the nozzle to thereby ensure more consistent flame ignition and combustion.

8 Claims, 3 Drawing Sheets

BURNER NOZZLE WITH IMPROVED FLAME STABILITY

FIELD OF THE INVENTION

The present invention generally relates to burner apparatus, and more particularly relates to burner nozzles for mixing fuel and air.

BACKGROUND OF THE INVENTION

Burners are used to provide heat in a variety of industrial applications. In general, burners employ a conventional nozzle to mix fuel and air and thereby create a combustible mixture.

Unfortunately, conventional nozzles do not cleanly and completely burn the air-fuel mixture over the entire operational range of the burner. Burners are generally capable of operating over a specified range of air and fuel inputs Conventional nozzles typically achieve optimum mixture over a limited range of air and fuel inputs. Within the preferred range, mixture of the fuel and air is complete and the burner cleanly burns the mixture. Operation of conventional burners with air and fuel inputs outside of the preferred range, however, causes poorer quality mixing of fuel and air by the nozzle. At certain inputs, the nozzle does not mix the air and fuel completely, causing less clean combustion which thereby increases the amount of combustion byproducts such as carbon monoxide and hydrocarbons. At other inputs, the air flow through the nozzle quenches the flame, thereby reducing the temperature of the flame which leads to incomplete combustion.

Conventional nozzles also have difficulty igniting a flame at low fire. To ignite a flame, the nozzle must thoroughly mix the air and fuel to obtain a combustible mixture. At low input levels, conventional nozzles fail to consistently provide a sufficient air-fuel mixture, thereby reducing the probability of igniting a flame. To address this problem, burners using conventional nozzles often incorporate a separate pilot which provides a continuous support flame.

In some applications, it is desirable to have only a portion of the total combustion take place immediately at the nozzle, with the remainder of combustion taking place downstream of the combustion chamber. In such applications, a certain amount of combustible mixture is needed at the burner nozzle to maintain flame. Air and fuel not combusting immediately at the nozzle flows downstream of the nozzle to mix and combust at a point downstream of the burner. In this manner, a greater amount of heat is delivered to the downstream location for a given size burner.

Unfortunately, burners using conventional nozzles do not adequately control the amount of combustion taking place downstream of the combustion chamber. The air hole pattern of a conventional burner nozzle has air holes spaced throughout the entire radius of the nozzle. As a result, it is difficult to determine which holes are associated with immediate mixing near the nozzle and which holes provide mixing downstream of the nozzle. Control over immediate and downstream mixing is particularly advantageous in burner applications, such as immersion tube burners, which require a portion of the combustion to take place downstream of the nozzle.

Nozzles used in immersion tube burners have a particular problem producing stable combustion at high firing rates when first ignited due to high back pressures inherent in such systems. It is often desirable to run a burner at or near its heating capacity immediately upon start-up. The conventional nozzles of these burners, however, have difficulty maintaining a stable flame at higher firing rates when first ignited. One approach to this problem has been to provide a pilot assembly which warms the combustion chamber before running at high fire. The pilot assembly, however, wastes time and money since the user must wait for the pilot to heat the combustion chamber before running the burner at high fire.

SUMMARY OF THE INVENTION

A general aim of the present invention is to provide a burner nozzle with improved flame stability characteristics.

It is a related object of the present invention to provide a burner nozzle which adequately mixes air and fuel to produce stable combustion over a wide range of firing rates.

Another object of the present invention is to provide a burner nozzle which allows improved control over the amounts of immediate and downstream combustion taking place.

It is a feature of the present invention to provide a burner nozzle having a mixing plate with primary and secondary hole zones. The primary and secondary zones are located relative to outlet ports which supply fuel to the burner. The primary zone is located closer to the fuel outlet ports so that fuel and air are optimally mixed from low to high firing rates. As a result, when an ignition source is located near the primary zone, the burner reliably ignites over a wide firing range.

The division of air holes in the mixing plate further improves control over the amount of combustion occurring immediately at the nozzle and the amount taking place downstream of the nozzle. The primary zone, as noted above, is associated with immediate mixing of a combustible fuel-air mixture, while the secondary zone allows the fuel and air to mix more completely downstream of the nozzle. The primary zone is located nearest the center of the burner nozzle and has holes located within a pre-determined distance from the fuel outlet ports. Fuel exiting the outlet ports will maintain a relatively constant velocity for a given distance. The air holes of the primary zone are located within this distance so that immediate mixing and combustion of fuel and air take place. A secondary zone of holes is located near the periphery of the mixing plate. The secondary zone is located at a distance from the outlet ports at which the fuel velocity has substantially decayed. Furthermore, combustion air is introduced through the air holes substantially perpendicular to and with greater momentum than the fuel flow. As a result, the fuel travels substantially parallel to the air from the secondary zone and mixing therefore takes place downstream of the burner nozzle. By apportioning holes between the primary and secondary zones, the amounts of immediate and downstream combustion are better controlled.

These and other objects and advantages of the invention will become more apparent from the following detailed description when taken in conjunction with the accompanying drawings.

Figure 1:
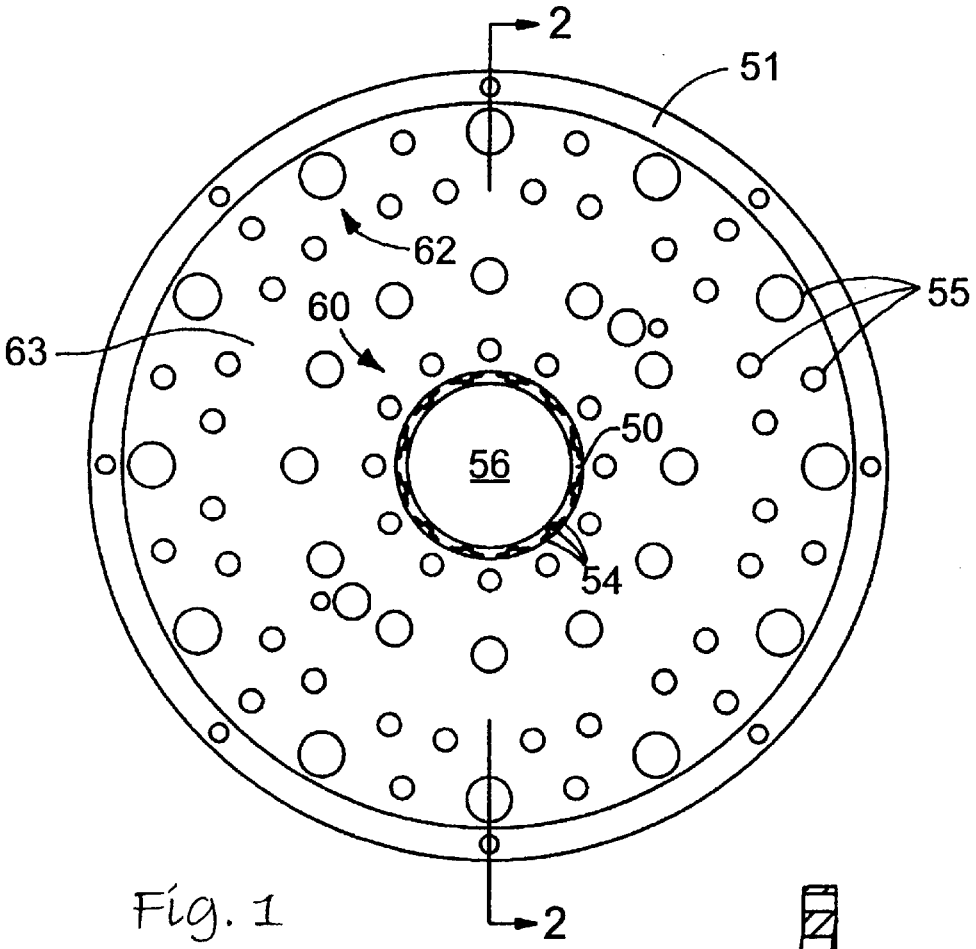
FIG. 1 is a front view of the burner nozzle in accordance with the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENTS

Figure 3:
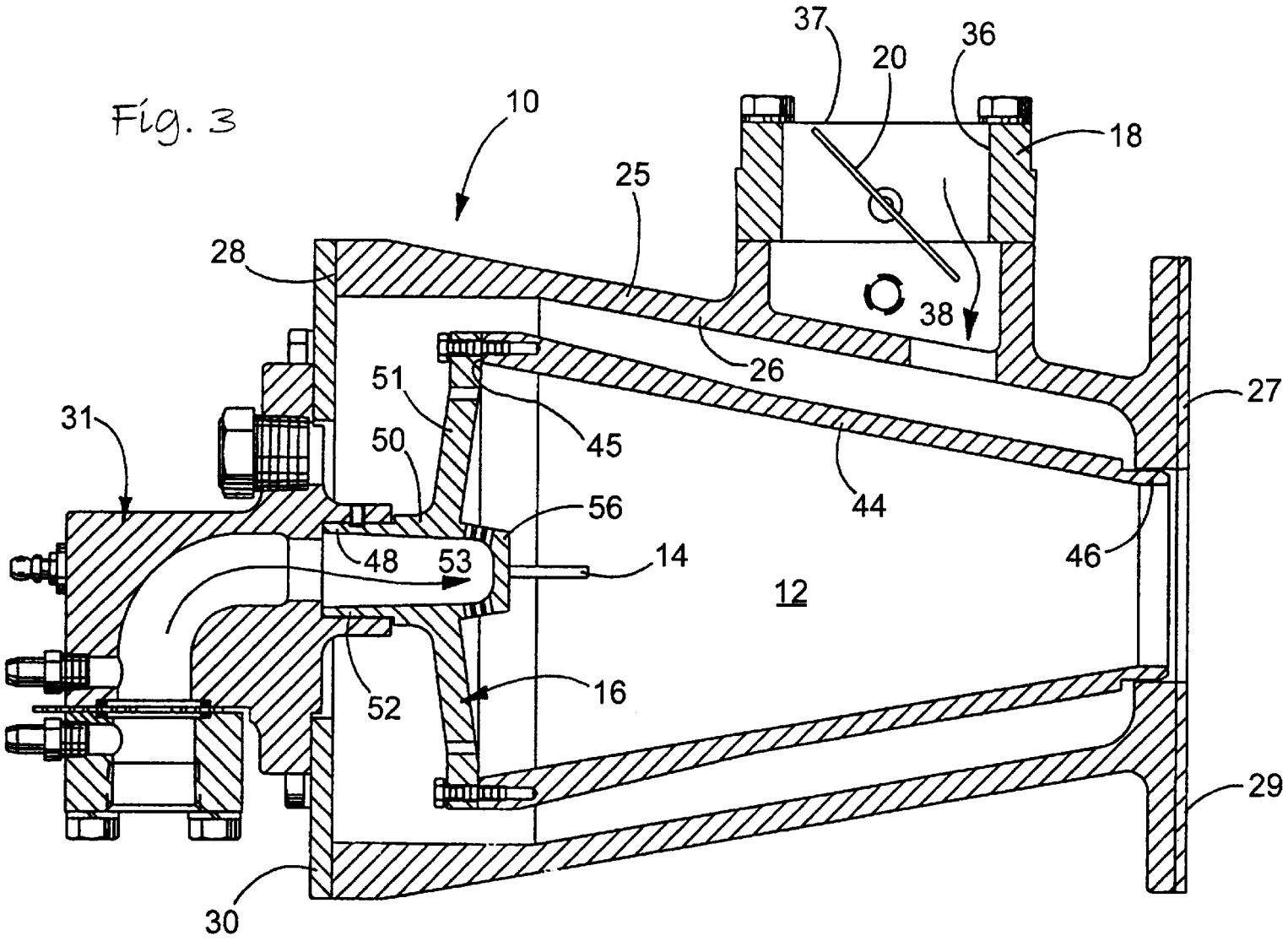
FIG. 3 is a sectional side view of the burner nozzle installed in an immersion tube style burner.

Referring now to the drawings, and specifically to FIG. 1, a burner nozzle 16 in accordance with the present invention is shown. Illustrated in FIG. 3 is the burner nozzle 16 installed in a burner 10. In the illustrated embodiment, fuel and air are supplied to the burner 10 for mixing in a combustion chamber 12 to create a flammable mixture. An igniter assembly, schematically shown in FIG. 3 as reference numeral 14, is located in the combustion chamber 12 for initiating the flame. In operation, fuel and air are mixed at a burner nozzle 16 and ignited, thereby burning the air-fuel mixture.

A fan (not shown) is preferably used for forcing combustion air through the burner 10. The fan is connected to air inlet 18 which, in the embodiment illustrated in FIG. 3, carries a butterfly valve 20 for controlling the amount of air delivered to the burner 10. It will, however, be appreciated that the butterfly valve 20 need not be connected directly to the air inlet 18 but may be located at any point between the fan outlet and burner inlet. When the air and fuel are mixed in appropriate proportions, the igniter 14 initiates a flame in the combustion chamber 12.

In greater detail, the burner nozzle 16 is sized to fit inside a housing 25. The nozzle 16 is adapted to be installed on the combustion chamber 12. As best shown in FIG. 3, the housing 25 preferably has a frusto-conical side wall 26 having front and rear ends 27, 28. The shape of the side wall 26 generally corresponds to that of the combustion chamber 12. A mounting flange 29 is located con the front end 27 for attaching the burner 10 to piping or directly to a wall of the tank. In the preferred embodiment, a back plate 30 is attached to the side wall 26 at the rear end 28. The back wall 30 accommodates fuel supply apparatus 31 which delivers fuel to the burner 10.

The housing further has an air inlet 18 for allowing combustion air to enter the burner 10. In the preferred embodiment, the air inlet 18 comprises a cylindrical inlet wall 36 formed integrally with the housing 25. A free end 37 of the inlet wall 36 is adapted to be attached to a fan or additional piping which leads to a fan. The inlet wall 36 forms an inlet air passage 38 which conducts air from the fan to the interior of the housing 25. A butterfly valve 20 is centrally mounted in the inlet wall 36 to control the flow of air through the inlet air passage 38.

The burner illustrated in FIG. 3 has a combustion sleeve 44 which defines the combustion chamber 12 where a portion of the fuel and air are mixed and burned. The combustion sleeve 44 has a generally frusto-conical shape having intake and discharge ends 45, 46. According to the illustrated embodiment, the intake end 45 is larger in diameter than the discharge end 46 and is attached to the burner nozzle 16. While various means can be used to attach the combustion sleeve 12 to the burner nozzle 16, in the currently preferred embodiment the burner nozzle is adapted to be bolted to the sleeve. This method of attachment allows for easier assembly and disassembly.

Figure 2:
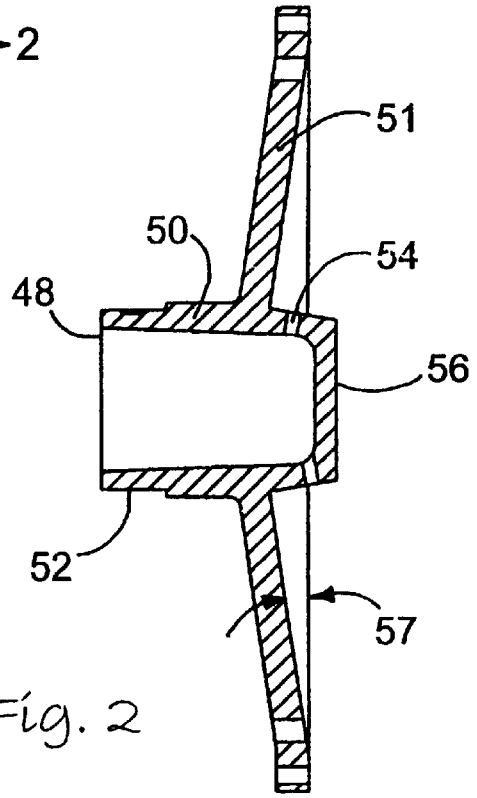
FIG. 2 is a sectional side view of the burner nozzle taken along line 2—2 of FIG. 1.

The burner nozzle 16 is provided for introducing air and fuel into the combustion chamber 12 (FIGS. 1 and 2). The burner nozzle 16 generally comprises a center shaft 50 and a mixing plate 51. The center shaft 50 is aligned along an axis and has attachment and discharge ends 48, 56. A recessed sleeve 52 is located at the attachment end 48 and is adapted to engage the fuel supply apparatus 31. As noted above, the combustion sleeve 44 is attached to a periphery of the mixing plate 51. Accordingly, it will be appreciated that the burner nozzle 16 is substantially coaxially aligned with the combustion sleeve 44.

Turning to the center shaft 50 of the burner nozzle 16 in greater detail, it will be noted that the center shaft generally defines a fuel inlet path 53 leading from the fuel supply apparatus 31 to a plurality of fuel outlet ports 54. As best shown with reference to FIGS. 1 and 2, fuel outlet ports 54 are spaced radially about the discharge end 56 of the center shaft 50. The fuel outlet ports 54 may be arranged in a number of different patterns and diameter sizes. In the preferred embodiment, the fuel outlet ports 54 are arranged in radially spaced groups of three, each group generally defining a triangular shape. In this manner, fuel supply to the burner nozzle 16 is dispersed about the entire radius of the discharge end 56.

The mixing plate 51 extends substantially radially from the center shaft 50 between the attachment and discharge ends 48, 56. The mixing plate 51 allows air to pass through and mix with fuel in the combustion chamber 12. As best shown in FIG. 1, a plurality of radially disposed air holes 55 are located in the mixing plate 51 at various diameters. Combustion air passes through the air holes 55 to mix with the fuel discharged from the fuel outlet ports 54, thereby creating a combustible mixture of air and fuel. The igniter assembly 14 extends into the combustion chamber 12 near the mixing plate 51 for initiating flame in the combustion chamber.

The mixing plate 51 preferably has a cone shape to improve flame stability. As best shown in FIG. 2, the mixing plate 51 has an angle 57 to form a frusto-conical shape. The cone shape increases the re-circulation of hot gases to the base of the flame, thereby stabilizing the flame over a high turn down ratio. The re-circulation function is achieved over a wide range of angles for the mixing plate 51. In the preferred embodiment, the angle 57 of the mixing plate 51 is 8 degrees with respect to a plane normal to the axis of the center shaft 50.

To further stabilize the flame over a large turn down range, the air holes 55 are arranged in a plurality of radially spaced zones. The air holes 55 in the mixing plate 51 allow air to enter the combustion chamber 12 and are arranged to form a primary zone 60 located closer to the fuel outlet ports 54 and a secondary zone 62 located farther from the fuel outlet ports 54. According to the embodiment illustrated in FIG. 1, the primary zone 60 is located nearer the center of the mixing plate 51 and the secondary zone 62 nearer the outer periphery of the mixing plate. The mixture of fuel and air is optimized in the primary zone 60 so that a combustible mixture is created at low and high fire ignition. By separating the air holes 55 into primary and secondary zones 60, 62, the burner nozzle provides stable ignition over low and high firing rates.

The air holes 55 may have a wide variety of diameters and different diameter holes may be used in the same mixing plate 51. Furthermore, the air holes 55 may be arranged at different diameters in the mixing plate. According to the embodiment illustrated in FIG. 1, the mixing plate 51 has various diameter air holes 55 disposed at four (4) different diameters. The air holes 55 at the two inner diameters make up a first or primary zone 60 and the air holes 55 at the two outer diameters form a secondary zone 62. A relatively thin, annular band 63 having no holes exists between the outer diameter of the primary zone 60 and the inner diameter of the secondary zone 62 delineates the two zones.

According to a detailed aspect of the present invention, the size of the primary zone 60 is determined by the diameter of the fuel outlet ports 54. It will be appreciated by those skilled in the art that fuel exiting a circular port will maintain a relatively constant velocity and direction after leaving the port for a distance of approximately five port diameters. After traveling beyond this distance, the velocity of the fuel begins to decay. In addition, air introduced through the air holes 55 has significantly greater momentum (due primarily to the greater mass of the air) than the fuel and therefore the fuel loses its original direction of travel. It will further be appreciated that optimum mixing occurs when the fuel and air are introduced normal to one another. More complete mixing therefore takes place in the burner 10 when the fuel is introduced normal to the direction of air flow, and this mixing will exist as long as the fuel maintains its velocity and direction. Since the distance at which the fuel maintains its velocity, and therefore direction, is equal to approximately five times the diameter of the fuel outlet ports 54, the primary zone 60 is located within this distance. By sizing the primary zone 60 in this manner, optimal mixing will occur within the primary zone 60 to ensure the creation of a flammable mixture over a wide turn down range.

The use of primary and secondary zones 60, 62 further allows more precise control over the amount of immediate and downstream combustion. As noted above, it is desirable for some burners, such as an immersion tube burner, to simply initiate flame inside the burner and to have a majority of combustion take place downstream of the nozzle to thereby maximize the amount of heat delivered to a desired downstream location. By locating the secondary zone 62 beyond the five diameter distance, the fuel velocity will decay and be influenced by the air flow, ultimately resulting in a fuel flow directed substantially parallel to the air flow. The air and fuel from the secondary zone therefore does not mix completely in the combustion chamber but, rather, mixes downstream of the nozzle to create a flammable mixture. The amount of combustion taking place within the primary and secondary zones 60, 62 is controlled by the ratio of air holes 55 located in each zone. For example, in the preferred embodiment, the primary zone 60 has a hole area which allows approximately 35% of the total air to pass through. The remainder of the air passes through the holes located in the secondary zone 62. As a result, roughly 35% of the combustion produced by the burner takes place in the primary zone 60 within the combustion chamber 12. At the secondary zone 62, the fuel velocity has decayed so that it travels substantially parallel to the flow of air. As a result, only minimal mixing takes place in the secondary zone and, instead, the fuel and air mix downstream of the nozzle to form a combustible mixture. Accordingly, in the preferred embodiment, roughly 65% of combustion takes place downstream.

While a wide range of percentages of holes may be used in the primary zone 60, the amount of holes located in that zone must be selected so that the air-fuel mixture produced in that zone is within the flammability limits. Different fuels have different flammability limits. For example, when using natural gas as the fuel, the air-fuel mixture must contain between 5 and 15% natural gas to maintain a flammable mixture. In a typical burner system, the amount of air delivered to the burner varies with the amount of fuel input. During high fire conditions, the percentage of fuel in the air-fuel mixture is higher than during low fire conditions. As a result, the upper range of the flammability limit is more likely encountered at high fire and the lower limit at low fire. When using natural gas as the fuel, the number of holes in the primary zone 60 must be selected so that the fuel-air mixture has less than 15% fuel during high fire and more than 5% fuel at low fire. As noted above, the flammability limits are different for different fuels and therefore different fuel percentages create the upper and lower limits. In the preferred embodiment, it has been found that delivering 35% of the total air to the primary zone 60 maintains combustion over a wide turn down range.

Figure 4:
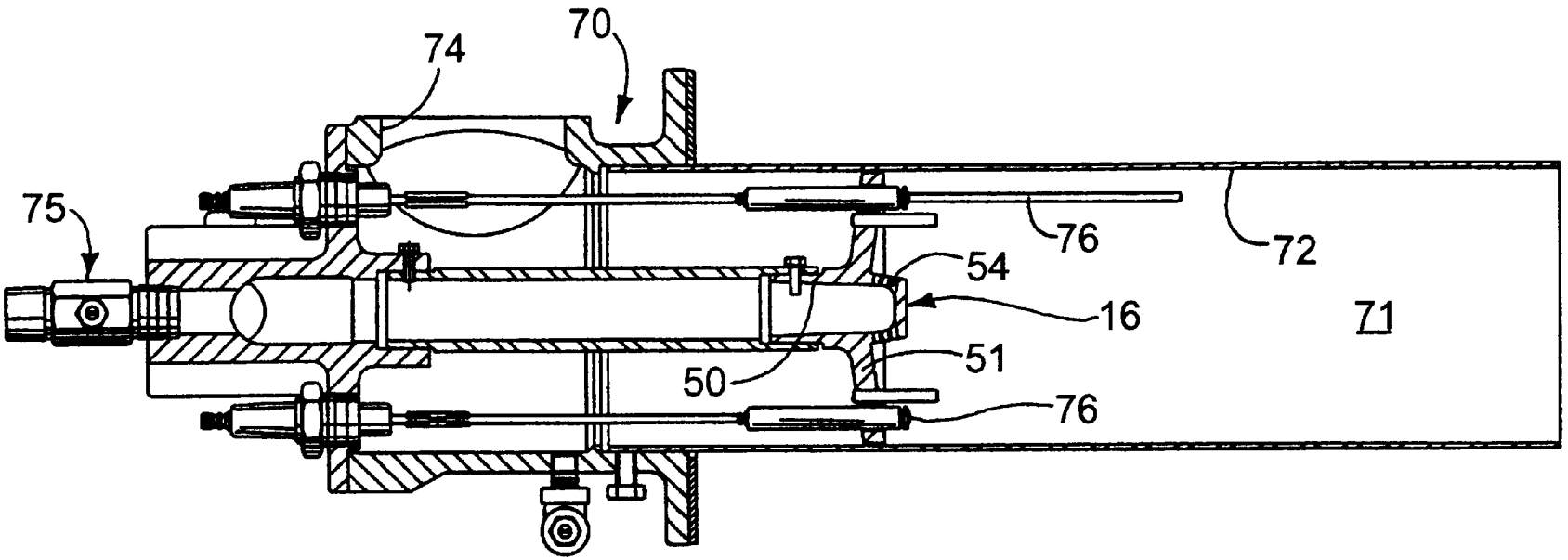
FIG. 4 is a sectional side view of the burner nozzle installed in a gun style air heat burner.

In the alternative embodiment illustrated in FIG. 4, the present invention is shown installed in a gun style burner commonly used to heat process air in industrial applications. The burner nozzle 16 in this embodiment is identical to the above nozzle and thus will be described only briefly. In this embodiment, the burner nozzle 16 is disposed in a burner 70 having a cylindrical combustion chamber 71. The burner nozzle has a center shaft 50 and a mixing plate 51 similar to the previous embodiment. The edges of the mixing plate 51 engage a combustion sleeve or wall 72 which defines the combustion chamber 71. Air is supplied to the burner through a combustion air inlet 74 and fuel supply apparatus 75 provides fuel to the nozzle. The air holes 55 in the mixing plate 51 allow air to flow into the combustion chamber 71, as shown in FIG. 1. Fuel outlet ports 54 create a fuel flow which is perpendicular to the air flow to maximize mixing near the center shaft 50 of the nozzle 16. An igniter assembly 76 creates a spark for igniting the fuel-gas mixture.

In the alternative embodiment, the air holes 55 in the mixing plate 51 are again arranged into a primary zone 60 for immediate mixing near the nozzle and a secondary zone 62 which allows mixing downstream of the nozzle (FIG. 1). The primary zone 60 is sized to be within roughly five diameters of the fuel outlet ports 54. The percentages of total hole area in each zone is determined by the amount of combustion desired downstream. In the preferred embodiment, the primary zone 60 comprises 35% of the total hole area. In the most preferred embodiment, the mixing plate 51 is angled to have a conic shape. It will therefore be appreciated that the burner nozzle 16 of the present invention is adapted for use in a wide range of burner types.

From the foregoing, it will be appreciated that the present invention provides a new and improved burner nozzle. The present invention incorporates a number of features in order to maintain a stable and efficient flame. The burner has a mixing plate which is cone-shaped so that hot gas is recirculated back towards the burner nozzle to ensure combustion and stabilize the flame. In addition, the mixing plate has primary and secondary zones which ensure ignition over a wide range of firing rates and help control the amount of immediate and downstream combustion. The primary zone is sized according to the diameter of the fuel outlet ports. The air holes in the primary zone are located within this range to optimize the mixture of air and fuel within this zone. As a result, the burner nozzle of the present invention creates a combustible mixture over a wide range of firing rates. The primary and secondary zones further delineate the amount of combustion taking place within the combustion chamber and downstream of the nozzle. As noted above, the primary zone creates a combustible mixture which is immediately ignited inside the combustion chamber. The air holes of the secondary zone are located at a distance from the fuel outlet ports so that the velocity of the fuel is substantially decayed by the time it reaches that zone. As a result, the fuel and air at the secondary zone follow substantially parallel paths and therefore mix and combust downstream of the nozzle. The nozzle of the present invention is adapted for use in a wide range of burners.

What is claimed is:

1. A burner nozzle adapted for installation in a burner having a combustion sleeve, the burner nozzle comprising:

a center shaft aligned along an axis, the center shaft having an attachment end sized to accept fuel supply apparatus and a mixing end carrying a plurality of fuel outlet ports, fuel exiting the outlet ports at a substantially constant velocity for a given distance before decaying, and a mixing plate extending radially from the center shaft between the attachment and mixing ends, a periphery of the mixing plate adapted for connection to the combustion sleeve of the burner, the mixing plate having a first group of air holes located within the given distance from the fuel outlet ports and a second group of air holes located beyond the given distance from the fuel outlet ports, air flowing through the first group of air holes to immediately mix with fuel to provide primary combustion, air flowing through the second group of air holes to mix with fuel further downstream of the mixing plate to provide secondary combustion, an imperforate intermediate zone extending between the first and second groups.

2. The nozzle of claim 1 in which the fuel outlet ports are round and the given distance within which the air holes of the primary zone are located is about 5 times a diameter of the fuel outlet ports.

3. The nozzle of claim 2 in which the fuel outlet ports are disposed in a circular pattern about the mixing end of the center shaft and the mixing plate has a generally circular shape, the air holes of the primary zone extending radially in an inner annular band within the given distance from the fuel outlet ports, and the air holes of the secondary zone extending radially in an outer annular band outside of the given distance from the fuel outlet ports.

4. A burner nozzle adapted for installation in a burner having a combustion sleeve, the burner nozzle comprising:

a center shaft aligned along an axis, the center shaft having an attachment end sized to accept fuel supply apparatus, and a mixing end carrying a plurality of fuel outlet ports, the fuel outlet ports having a given diameter, and a mixing plate extending radially from the center shaft between the attachment and mixing ends, a periphery of the mixing plate adapted for connection to the combustion sleeve of the burner, the mixing plate having a first group of air holes located within five times the given diameter from the fuel outlet ports and a second group of air holes located beyond five times the given diameter from the fuel outlet ports, an imperforate intermediate zone extending between the first and second groups.

5. The nozzle of claim 4 in which the air holes are located at a plurality of discreet diameters, both the primary and secondary zones including at least one discreet diameter of air holes.

6. The nozzle of claim 4 in which a total hole area of the mixing plate is defined by a sum of cross-sectional areas of all the air holes in the mixing plate, the air holes in the primary zone comprising about 35% of the total hole area.

7. The nozzle of claim 6 in which the mixing plate forms an angle with respect to a plane normal to the axis of the center shaft.

8. The nozzle of claim 7 in which the angle is about 8 degrees.

* * * * *